US009750990B2

(12) United States Patent
Chang et al.

(10) Patent No.: US 9,750,990 B2
(45) Date of Patent: Sep. 5, 2017

(54) GOLF CLUB HEAD AND LOW DENSITY ALLOY THEREOF

(71) Applicant: O-Ta Precision Industry Co., Ltd., Nei-Pu Industrial Zone Ping-Tung Hsien (TW)

(72) Inventors: Chuan-Hsien Chang, Nei-Pu Industrial Zone Ping-Tung Hsien (TW); Jui-Ming Su, Nei-Pu Industrial Zone Ping-Tung Hsien (TW); Chih-Yeh Chao, Nei-Pu Industrial Zone Ping-Tung Hsien (TW)

(73) Assignee: O-Ta Precision Industry Co., Ltd., Nei-Pu Industrial Zone Ping-Tung Hsien (TW)

( * ) Notice: Subject to any disclaimer, the term of this patent is extended or adjusted under 35 U.S.C. 154(b) by 275 days.

(21) Appl. No.: 14/481,075

(22) Filed: Sep. 9, 2014

(65) Prior Publication Data

US 2015/0080150 A1 Mar. 19, 2015

(30) Foreign Application Priority Data

Sep. 16, 2013 (CN) ..... 2013 1 0422754

(51) Int. Cl.
*A63B 53/04* (2015.01)
*C22C 14/00* (2006.01)

(52) U.S. Cl.
CPC ..... *A63B 53/04* (2013.01); *C22C 14/00* (2013.01); *A63B 2209/00* (2013.01)

(58) Field of Classification Search
USPC ..... 473/349, 324, 342
See application file for complete search history.

(56) References Cited

U.S. PATENT DOCUMENTS

| | | | | |
|---|---|---|---|---|
| 2,867,534 | A * | 1/1959 | Jaffee | C22C 14/00 420/418 |
| 2,893,864 | A * | 7/1959 | Harris | C22C 14/00 420/418 |
| 4,067,734 | A * | 1/1978 | Curtis | C23G 1/106 148/407 |
| 5,580,403 | A * | 12/1996 | Mazur | C22C 1/0458 148/407 |
| 5,698,050 | A * | 12/1997 | El-Soudani | C22F 1/183 148/669 |
| 7,670,445 | B2 * | 3/2010 | Gejima | A63B 53/12 148/417 |
| 2004/0221929 | A1 * | 11/2004 | Hebda | C22C 14/00 148/670 |
| 2006/0045789 | A1 | 3/2006 | Nasserrafi et al. | |

(Continued)

*Primary Examiner* — Nini Legesse
(74) *Attorney, Agent, or Firm* — Muncy, Geissler, Olds & Lowe, P.C.

(57) ABSTRACT

A golf club head and a low density alloy thereof are provided. The low density alloy has a balanced weight percentage of titanium, 10~11 wt % aluminum, and trace elements including (C+N+O) <0.2 wt %, silicon <0.2 wt %, and (Fe+Cr+V+Mo) <0.4 wt %. The golf club head has a tensile strength of 90~110 kips/in$^2$, and a density of 4.18~4.30 g/cm$^3$. Through heat treatment at a high temperature of 925±25° C., the precipitation or $\alpha_2$ phase of the interfacial interphase can be avoided, and thus the embrittlement phenomena can be improved.

6 Claims, 13 Drawing Sheets

(56) References Cited

U.S. PATENT DOCUMENTS

| | | | | |
|---|---|---|---|---|
| 2008/0050266 | A1* | 2/2008 | Chen | C22C 14/00 420/420 |
| 2008/0283162 | A1* | 11/2008 | Chiang | A63B 53/04 148/671 |
| 2010/0178996 | A1* | 7/2010 | Chao | A63B 53/0466 473/342 |
| 2010/0180991 | A1* | 7/2010 | Heritier | C22F 1/183 148/669 |
| 2011/0218052 | A1* | 9/2011 | Hu | A63B 53/04 473/349 |
| 2014/0283364 | A1* | 9/2014 | Chiang | A63B 53/04 29/527.1 |

* cited by examiner

GOLF CLUB HEAD AND LOW DENSITY ALLOY THEREOF

CROSS REFERENCE TO RELATED APPLICATIONS

This application claims the priority of China Patent Application No. 201310422754.1, filed on Sep. 16, 2013, the disclosure of which is incorporated herein by reference.

FIELD OF THE INVENTION

The present invention relates to a golf club head and a low density alloy having balanced titanium, 10~11 wt % aluminum, and trace elements comprising (C+N+O)<0.2 wt %, Si<0.2 wt %, (Fe+Cr+V+Mo) <0.4 wt %, wherein the mixing ratio of titanium and aluminum is controlled, and then an appropriate heat treatment is applyied, so that the precipitation or $\alpha_2$ phase of the interfacial interphase of the alloy can be avoided, and thus the elongation of the alloy can be improved to 6~15%. Moreover, the alloy has a tensile strength of 90~110 kips/in$^2$ and a density of 4.18~4.30 g/cm$^3$ so as to adjust the position of barycenter to enhance the design flexibility of the golf club head.

BACKGROUND OF THE INVENTION

For the past two decades, titanium alloy has been widely used in the golf club industry because it has excellent corrosion resistance and high specific strength (strength and density ratio. Titanium alloy currently accounts for about 30 to 40 percent of the overall market.

Early in the selection of titanium alloy materials, pure titanium (G4) and Ti-6A1-4V were mainly chose because they have the character of making the golf club head (Driver) from the original volume using an iron-based alloy of 250~270 cc raised to 320~350 cc. With increased design requirements for the club head, a high-intensity β-type titanium alloy started to be used about ten years ago, such as 15-3-3-3, 10-2-3, 2041 titanium alloys. The main feature is allowing the volume of the golf club head to be raised to 400~450 cc.

With the enhancement and stability in process technology, the volume of the current titanium golf club head (Driver) has reached 450~470 cc, complying with the international norm of 460 cc. In addition, considering the cost of raw materials, the golf club head industry also uses molybdenum and/or chromium containing alloys, such as: 4.5-3-1-1, SP700, BT14, 5-1-1-1, Ti735, etc. Moreover, considering the low Young's modulus and shock/vibration absorption, high molybdenum alloys, such as 15-3 and 15-5-3, have also been developed.

The golf club head can be broadly divided into three categories: wood, iron, and putter, summarized as follows:

1. Wood head: It is used for the drive, and the requirement is to hit the ball a long, straight distance. Because titanium alloy has a high specific strength and low proportions, the sweet area is larger, thereby maintaining the stability of direction. Wood clubs are generally formed with stainless steel, but a combination of different materials for producing the composite wood head can create a counterweight to achieve the best results.

2. Irons head: It is used for hitting the ball to the greens or scheduled locations, and the requirements are accuracy and stable flight distance. The material is mainly stainless steel. Regarding the material of the iron head, the major development are: an elongation of 20~30% and a high strength (over 150 kips/in$^2$), or a strength of 100~120 kips/in$^2$ (psi) and a high elongation (over 30%).

3. Putter: The putter is used to push the ball into the hole on the greens, which is mainly used to control the direction of the ball and focuses on balance. This means preventing the striking plate from rotating while maintain the putter club head and the pipe. Recently, computer numerical control (CNC) has been used to process the club head in order to maintain the position of the designed barycenter and the uniformity of the club head.

In recent years, due to the limited volume of the club head, in order to increase the design flexibility of the club head in the weight distribution, a titanium alloy with a density lower than that of Ti-6Al-4V (US 2006/0045789, 4.42~4.48 g/cm$^3$) has been thus developed, which is an important development for the golf club industry. For example, the Ti-8Al-1V-1Mo alloy began mass production in 2009 (cast density of 4.30~4.36 g/cm$^3$).

Titanium alloy is an excellent material for the golf club head, but the design of the golf club head has moved toward the limit in recent years, without respect to thickness or shape. For example, the thickness of the striking face has decreased from 2.5 mm~3.6 mm to 2.1 mm~2.5 mm, and the thickness of the top cap has decreased from 1.0 mm~1.2 mm to 0.6 mm~0.8 mm, so that the result of the golf club head in the shelling test is between 200 and 4000 hits under the design conditions, and is much lower than the result of past experience, which is 5000-14000 hits. Regarding the general shelling test, the criteria is more than 3000 hits at a certain pace, so the property of the golf club head is disposed on the edge of the criteria. In addition, according to past analysis, if the process was once carried out between 800 and 950° C., the microstructure of the golf club heads made of 8-1-1 or 6-4 titanium alloys would cause an interphase to easily be formed between the α-phase/β-phase interfacial interphase, and induce the formation of microcracks; this is the main reason why the result in the shelling test is between 200 and 4000 hits.

However, due to the requirements of a large scaled golf club head and a variety of customizations, it is necessary to develop an alloy with a low density and high extension, but still maintaining mechanical strength in order to improve design flexibility.

Therefore, it is necessary to develop a golf club head and a low density alloy thereof to solve the problems existing in the conventional technology, as described above.

SUMMARY OF THE INVENTION

The primary object of the present invention is to provide a low density alloy of a golf club head, and develop the alloy with 89 to 90 wt % titanium, and 10 to 11 wt % aluminum (in percentage by weight) by adjusting the proportion of the content of aluminum in the titanium alloy. For the titanium alloy used for the structure at room temperature, a lower density of titanium alloy can be reached by adding aluminum. When the aluminum equivalent is 9.5 or more, $Al_{eq}$=Al %+10 (O+2N+C) wt %+0.333Sn wt %+0.166Zr wt %, the alloy easily forms a regular $DO_{19}$ of α2-phase during the heat treatment so that the elongation is decreased or embrittlement occurs. This is one of the reasons why the commercial titanium alloy is mainly composed of titanium-6 and vanadium-4. Currently, in the latest titanium alloy in mass production, the alloy composed of titanium-8 aluminum-1 vanadium-1molybdenum (Ti-8Al-1V-1Mo) has the lowest density (4.32~4.36 g/cm$^3$).Therefore, by increasing the content of aluminum, in particular reducing the density of the titanium alloy under as-cast condition, and the design flexibility of the golf club head will be further enhanced.

Fundamental phase change of titanium alloy: The unalloyed titanium will change to the allotropic form at 882° C. It has a hexagonal close-packed structure of α-phase below 882° C., and has a body-centered cubic structure of the β-phase over 882° C. According to the influence of the added alloy elements on β/α+β transition temperature, the a stabilizing element, such as aluminum, oxygen, carbon, and nitrogen, is to increase the stability of β/α+β transition temperature. The most important a stabilizing element is aluminum, due to its low density (the density of aluminum is 2.7 g/cm$^3$, the density of titanium is 4.5 g/cm$^3$), the lower cost, and the tensile strength and the creep strength of the titanium alloy are increased. The β stabilizing element, such as vanadium, molybdenum, chromium, and iron, is mainly to reduce β/α+β transition temperature. As the content of the β stabilizing element increases, β-phase at room temperature is increased. Adding neutral elements, such as tin, or zirconium, has no influence on β/α+β transition temperature; their main role is to increase the α-phase interfacial interphase. The titanium alloy has an area with different structure in the α phase and the β phase. The area is a composite interfacial interphase of a striated layer (SL) with high density of dislocations, and a monolithic layer (ML) without internal structure. The existence of the interfacial interphase provides growing paths for fatigue and cracks.

To solve the above problem, the present invention provides a casting titanium alloy, which contains, in weight percentage, 89~90% titanium, and 10~11% aluminum. Under the casting (precision casting), a density is in the range of 4.18~4.30 g/cm$^3$. Furthermore, the control of other unavoidable trace elements, such as (C+N+O)<0.2 wt %, Si<0.2 wt %, and (Fe+Cr+V+Mo) <0.4 wt %, and then heat treatment at a suitable temperature of 925±25° C. to adjust the casting structure avoids precipitation or $\alpha_2$ phase of the interfacial interphase produced for improving the brittleness and elongation. Also, processing hot isostatic pressing (HIP), forging, or swaging at 925° C.±25° C. can make the material homogenized.

The above casted titanium-aluminum alloy has an elongation at 6~15%, and a tensile strength at 90~110 kips/in$^2$. The content of titanium and aluminum of the Ti—Al alloy in the present invention is more than the content of the prior art, for example, 6Al-4V-Ti, and Ti-8-1-1. Increasing the content of aluminum has a significant effect in reducing the density and increasing the elastic modulus. Compared with 6Al-4V-Ti and Ti-8-1-1, the added amount of molybdenum or vanadium is greatly reduced, thereby reducing the manufacturing cost of the Ti—Al alloy, and the density thereof is lower than the similar alloys, which is advantageous to the large scaled golf club head, and increases the design flexibility.

Furthermore, in order to achieve the above object, the present invention provides a golf club head comprising a striking plate, a top, a bottom, a toe portion, a heel portion, and a handle tube, wherein at least a portion of the golf club head is made of the Ti—Al alloy of the present invention. The Ti—Al alloy comprises a balanced titanium by weight, 10 wt %-11 wt % aluminum, and trace elements comprising (C+N+O)<0.2 wt %, Si<0.2 wt %, and (Fe+Cr+V+Mo)<0.4 wt %. The Ti—Al alloy is subject to heat treatment at a temperature of 925±25° C. for 1~4 hours, so that the Ti—Al alloy has a tensile strength of 90~110 kips/in$^2$, and a density of 4.18~4.30 g/cm$^3$. For example, the top, bottom, a toe, and heel portion are made of the Ti—Al alloy of the present invention, the striking plate is made of 6-4 titanium alloy, SP700 or other conventional titanium alloys. However, the Ti—Al alloy of the present invention is able to be used in the striking plate.

In one embodiment of the present invention, the time of heat treatment is 1 hour.

In one embodiment of the present invention, the elongation of the titanium-aluminum alloy is 6~15%.

In one embodiment of the present invention, the volume of the golf club head is ranged between 410 and 470 cm$^3$, and the weight is ranged between 180 and 210 grams.

Furthermore, the present invention provides a low density alloy for a golf club head which comprises a balanced titanium by weight, 10~11 wt % aluminum, and trace elements comprising (C+N+O)<0.2 wt %, Si<0.2 wt %, and (Fe+Cr+V+Mo)<0.4 wt %. The low density alloy has a tensile strength of 90~110 kips/in$^2$, a density of 4.18~4.30 g/cm$^3$, and an elongation of 6~15%.

DETAILED DESCRIPTION OF THE PREFERRED EMBODIMENTS

Figure 1:
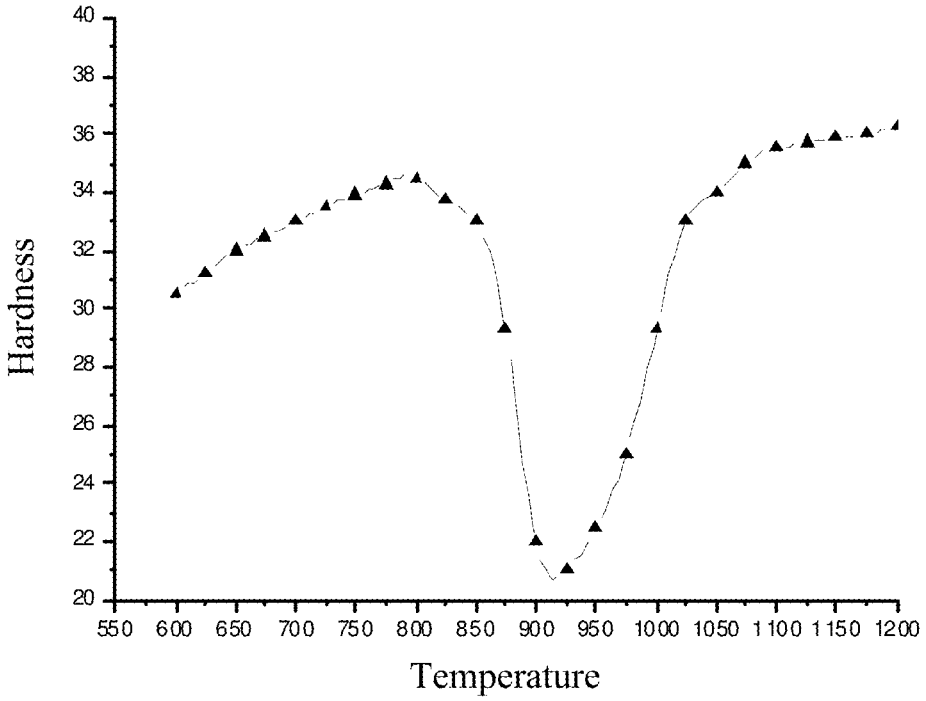
FIG. 1 is a hardness distribution diagram of the experiment 2 in the present invention heated at different temperatures for 1 hour.

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, etc., are only directions by referring to the accompanying drawings, and thus the used directional terms are used to describe and understand the present invention, but the present invention is not limited thereto.

Please refer to Table 1, the titanium-aluminum alloy (Ti—Al alloy) according to the embodiments of the present invention has the alloying elements comprising a balance titanium (Ti) by weight, and 10~11 wt % aluminum (Al). The density of the Ti—Al alloy is in a range of 4.18~4.30 g/cm$^3$. A variety of design proportions and the limiting scope of the alloying elements are described as follows.

Aluminum (Al): Al is added to the titanium alloy for reducing the density of the alloy, and to improve the strength of the alloy. The addition of aluminum may also form intermetallic compounds such as $Ti_3Al$ ($\alpha_2$-phase), and TiAl ($\gamma$-phase), the intermetallic compounds will cause the toughness (elongation) of the alloy to sharply declined at room temperature. In general, when the content of aluminum is less than 10.0% by weight, the density of the alloy is higher than 4.30 g/cm$^3$ (target); if the content of aluminum is greater than 11.0% by weight, the elongation of the alloy is less than 6% (target). Therefore, the content of aluminum of the alloy in the present invention should be strictly limited within the range of 10.0~11.0% by weight.

Carbon (C), nitrogen (N), and oxygen (0): they are grid gap atoms inevitable during alloy process. Considering that the aluminum equivalent ($Al_{eq}$=Al wt %+10(O+2N+C) wt %+0.333Sn wt %+0.166 Zr wt %), and the formation of $Ti_3Al$ ($\alpha_2$-phase) has to be avoided, the content of (C+N+O) should be strictly restricted to 0.2% or less.

Silicon (Si): Si added to the alloy will improve the strength of the alloy, but it will increase the brittleness at the same time. Thus, silicon is the inevitable element which existsduring alloy process. According to one embodiment of the present invention, the content of silicon in the alloy is limited to 0.2% or less by weight.

Chromium (Cr), iron (Fe), vanadium (V), and molybdenum (Mo): they are transition elements which are inevitable during alloy process. For the 64-titanium alloy regulations, the total content of the inevitable transition elements is less than 0.4% by weight. Further, in one embodiment of the present invention, the content of (Fe+Cr+Mo+V)<0.37% by weight. Therefore, the total content of the alloy in the present invention is limited to 0.4% or less by weight.

TABLE 1

Casting properties of embodiments and commercial Ti—Al alloy

| | wt % | | | | | | | | | | | | | | |
|---|---|---|---|---|---|---|---|---|---|---|---|---|---|---|---|
| Materials | Ti | Al | V | Mo | Si | O | C | N | Ir | Cr | Tensile strength klps/in$^2$ | Yield strength klps/in$^2$ | Elongation (%) | Hardness (HRc) | Density (g/cm$^3$) |
| 6-4Ti | Balance | 6.31 | 4.11 | 0.02 | 0.09 | 0.18 | 0.03 | 0.03 | 0.11 | 0.01 | 142.3 | 128.3 | 16.2 | 39.3 | 4.43 |
| Ti-8-1-1 | Balance | 7.82 | 0.88 | 1.01 | 0.07 | 0.06 | 0.04 | 003 | 0.02 | 0.13 | 122.3 | 110.4 | 17.2 | 31.4 | 4.35 |
| Exp. 1 | Balance | 10.21 | 0.08 | 0.12 | 0.14 | 0.06 | 0.03 | 0.05 | 0.12 | 0.05 | 96.0 | 91.8 | 12.5 | 23.3 | 4.27 |
| Exp. 2 | Balance | 10.32 | 0.12 | 0.02 | 0.10 | 0.04 | 0.02 | 0.04 | 0.05 | 0.04 | 102.2 | 95.3 | 8.9 | 25.5 | 4.24 |
| Exp. 3 | Balance | 10.78 | 0.03 | 0.06 | 0.08 | 0.06 | 0.03 | 0.05 | 0.08 | 0.04 | 104.3 | 94.7 | 8.1 | 26.1 | 4.21 |
| Exp. 4 | Balance | 10.88 | 0.08 | 0.07 | 0.11 | 0.05 | 0.02 | 0.04 | 0.06 | 0.05 | 105.1 | 98.4 | 6.9 | 27.5 | 4.20 |
| Ctrl. 1 | Balance | 9.11 | 0.01 | 0.11 | 0.12 | 0.06 | 0.04 | 0.02 | 0.12 | 0.11 | 112.4 | 107.6 | 13.1 | 29.3 | 4.32 |
| Ctrl. 2 | Balance | 9.65 | 0.02 | 0.10 | 0.08 | 0.08 | 0.03 | 0.03 | 0.21 | 0.12 | 115.4 | 104.4 | 12.8 | 28.5 | 4.30 |
| Ctrl. 3 | Balance | 11.25 | 0.09 | 0.10 | 0.12 | 0.05 | 0.03 | 0.04 | 0.16 | 0.20 | 100.4 | 99.4 | 4.2 | 26.8 | 4.18 |

Note:
The alloy of experiment cases and control cases in the present invention are subject to heat treatment at 925° C. for 1 hour after casting.

The alloy in the abovementioned embodiments is mainly a titanium-aluminum based alloy having a balanced titanium by weight, 10~11 wt % aluminum, and the inevitable trace elements comprising (C+N+O)<0.14 wt %, Si<0.14 wt %, and (Fe+Cr+V+Mo)<0.37 wt %. By a precision casting process, elongation in the range of 6.9~12.5%, tensile strength in the range of 96.0~105.1 kips/in$^2$, and density in the range of 4.20~4.27 g/cm$^3$ are obtained.

According to the golf club heads of the experiments 1~4 (i.e. exp. 1~4 in Table 1) in the present invention, the volume of the club head is preferably between 410 and 470 cm$^3$, and more preferably between 450 and 460 cm$^3$. The weight of the club head is about 180~210 grams. After durability testing using a shelling golf ball (ball size 90) at a shelling speed of 55.8 m/s by 3000 times, there are no cracks on the panel and/or the club head in visual inspection and flaw detection. In addition, although the strength of Control cases 1 and 2 (i.e. Ctrl. 1 and Ctrl. 2 in Table 1) comply with industrial requirements, the density is not within the expected range. Although the strength and density of Control case 3 is within the expected range, the elongation is too low to comply with industrial requirements, and a further development is needed. With respect to Ti-8-1-1 and 6-4Ti, the densities of the control cases are less than 4.35~4.43 g/cm$^3$.

Experiment case 2 according to the present invention, for example, a blank of the experiment case 2 can be produced under the precision casting (As-cast) without any heat treatment, the mechanical properties of the blank such as the tensile strength is 98.6 kips/in$^2$, the yield strength is 97.3 kips/in$^2$, the elongation is 1.4%, and the hardness HRc is 25.4. After treating at 925° C. for 1 hour, its mechanical properties are improved, such as the tensile strength is improved to 102.2 kips/in$^2$, the yield strength is improved to 95.3 kips/in$^2$, the elongation is improved to 8.9%, the hardness HRc is improved to 25.5, and the density is improved to 4.22 g/cm$^3$, and thus the alloy is suitable for being a body of a golf club head. The foregoing time of heat treatment is able to be appropriately extended to 2 hours, 3 hours, or 4 hours for giving a more uniform and dense material of the alloy.

Figure 2:
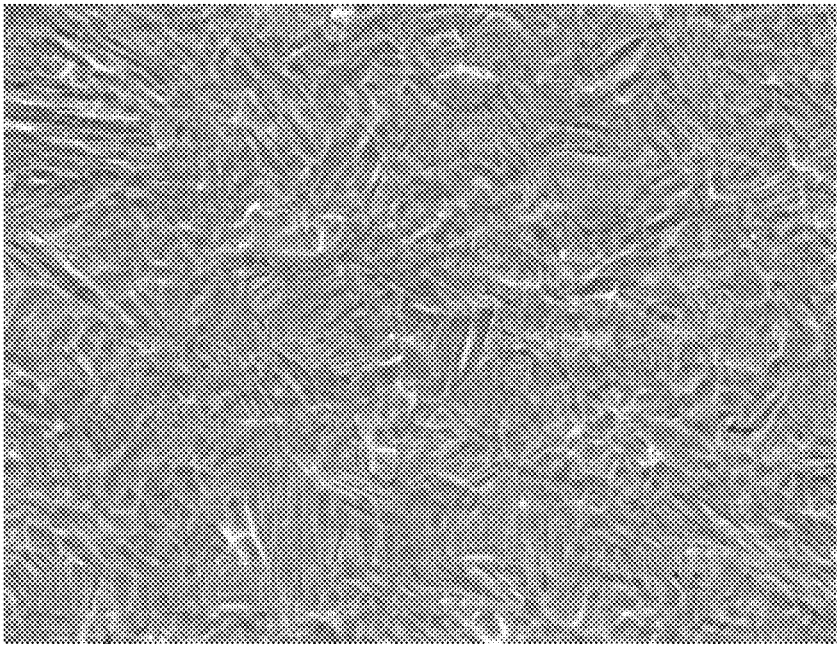
FIG. 2 is a view of the scanning electron microscope (SEM) observation of the experiment 2 in the present invention after treating at 800° C., which shows the acicular structure.
Figure 3:
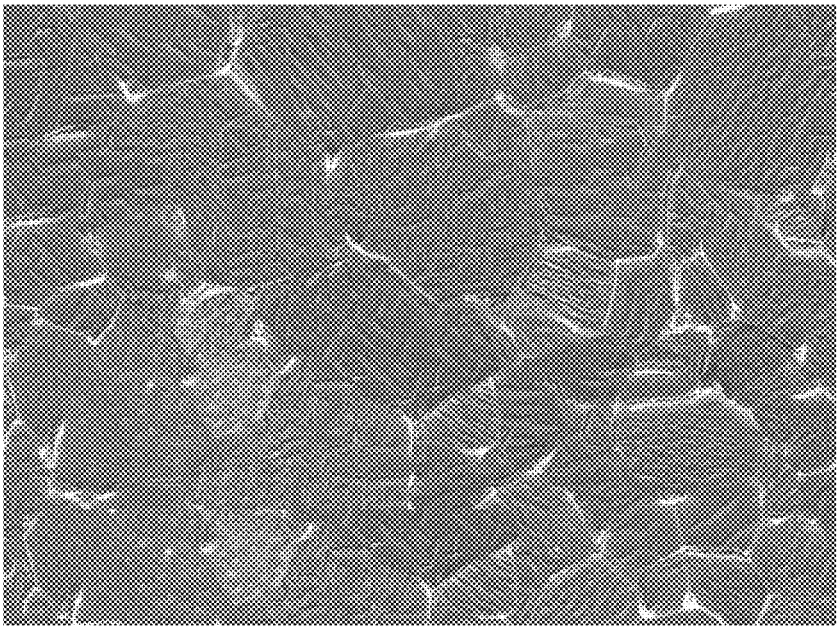
FIG. 3 is a view of the scanning electron microscope (SEM) observation of the experiment 2 in the present invention after treating at 900° C., which shows the acicular structure, and a grain size of about 30~80 μm.
Figure 4:
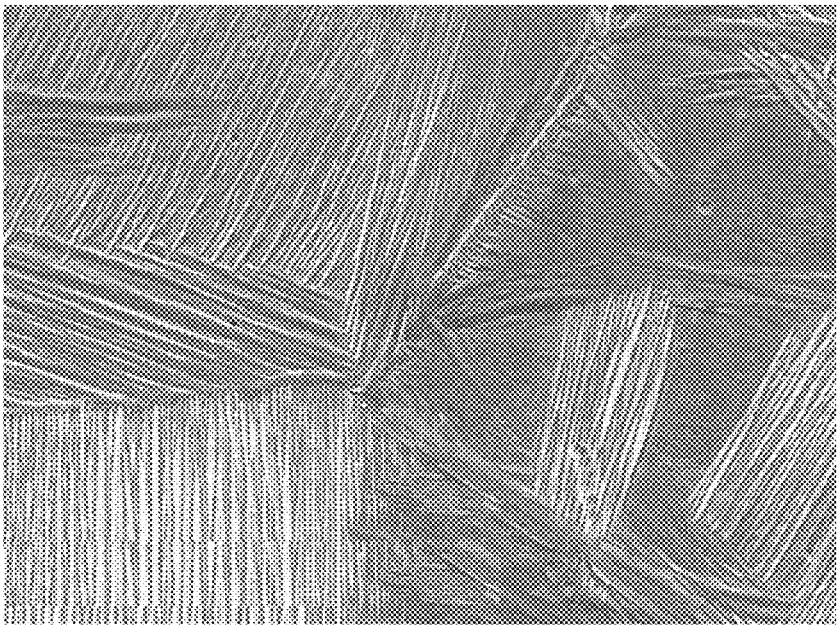
FIG. 4 is a view of the scanning electron microscope (SEM) observation of the experiment 2 in the present invention after treating at 1000° C., which shows the acicular structure, and a grain size greater than 200 μm.

In addition, according to Experiment case 2 of the present invention, when the alloy is heated at 700~1000° C. for 1 hour, the alloy hardness is measured at every interval of 25° C., and the hardness distribution is shown in FIG. 1. In FIG. 1, after heat treatment between 900 and 950° C. for 1 hour, the hardness achieves to a lower value, and the optimized elongation can be obtained in view of the mechanical properties and the alloy design. In the experiment case 2 of the present invention, the alloy casting after treating at 800° C., 900° C., and 1000° C. is inspected by scanning electron microscopy (SEM) treatment, as shown in FIGS. 2~4. FIGS. 2~4 show that different temperatures of heat treatment will cause different microstructures. Due to the different microstructures, different elongations are presented. Therefore, the optimized elongation can be obtained by heating at a temperature between 900 and 950° C. for 1 hour to form the proper microstructures of the alloy in the embodiments of the present invention.

Figure 5:
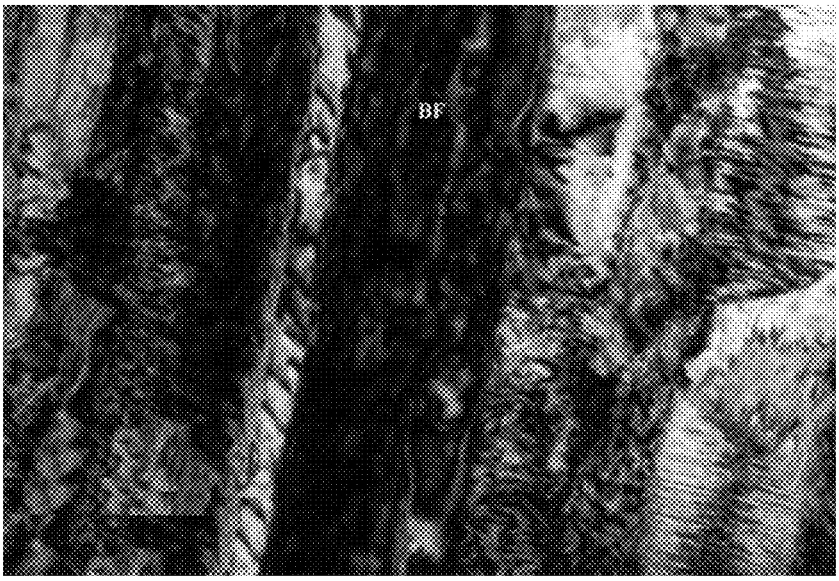
FIGS. 5(*a*), 5(*b*), 5(*c*) and 5(*d*) are views of the transmission electron microscope (TEM) observation of the experiment 2 in the present invention after treating at 1000° C., which show the needle organization base, where FIG. 5(*a*) is a bright field view, FIG. 5(*b*) is a dark field view, FIG. 5(*c*) is selected area diffraction pattern (SADP) by Axis [11$\bar{2}$0], and FIG. 5(*d*) is SADP by Axis [11$\bar{2}$3].
Figure 5:
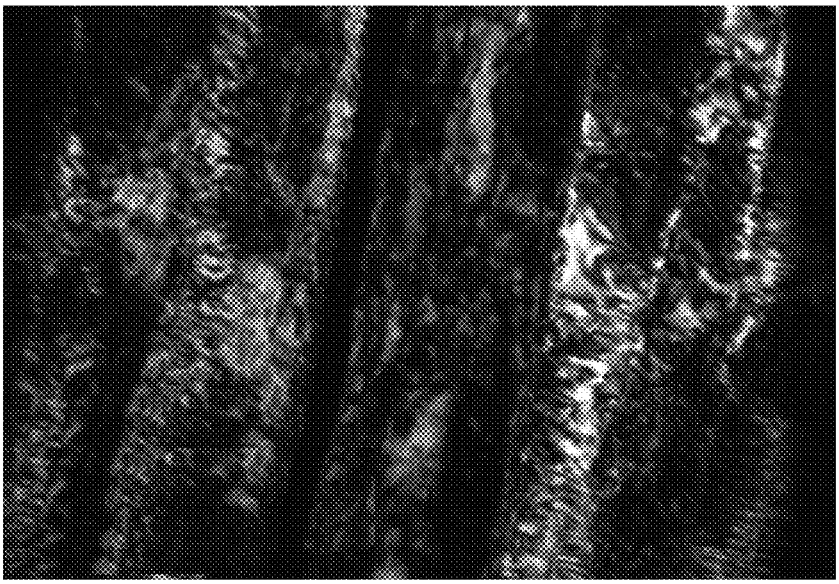
Figure 5:
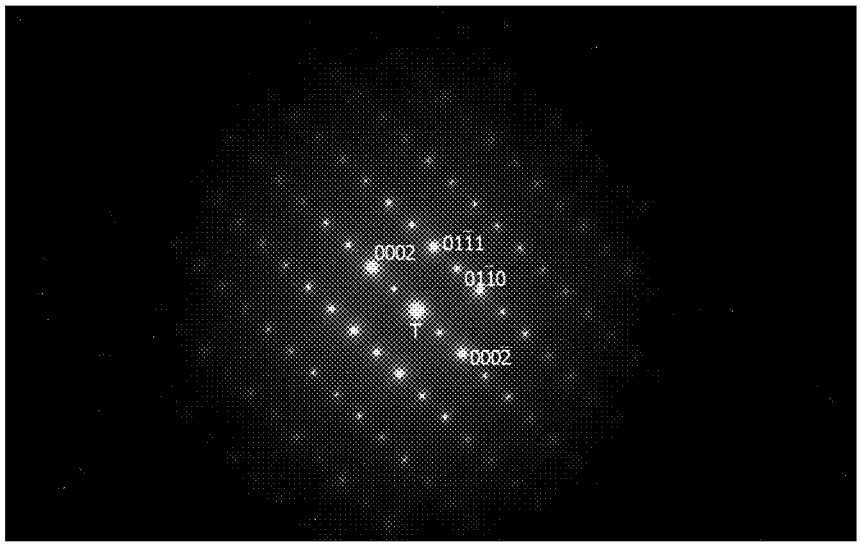
Figure 5:
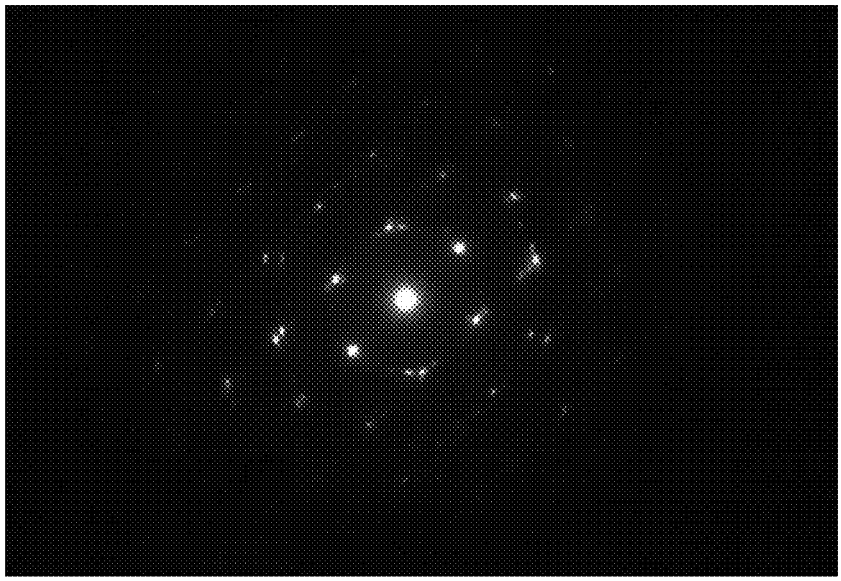
Figure 6:
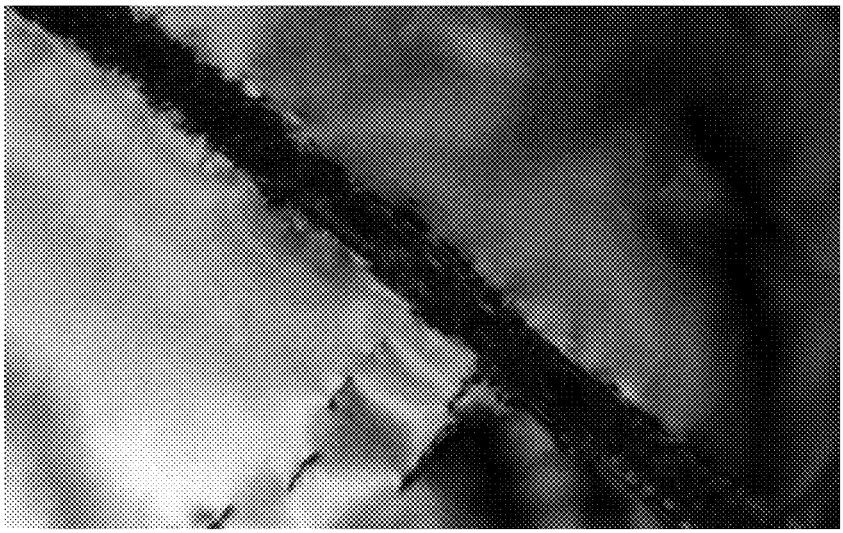
FIGS. 6(*a*), 6(*b*), 6(*c*) and 6(*d*) are views of the transmission electron microscope (TEM) observation of the experiment 2 in the present invention after treating at 1000° C., which show the FCO structural phase formed within the interfacial interphase, where FIG. 6(*a*) is a bright field view, FIG. 6(*b*) is a dark field view, FIG. 6(*c*) is SADP by Axis [11$\bar{2}$0], and FIG. 6(*d*) is SADP by Axis [11$\bar{2}$3].
Figure 6:
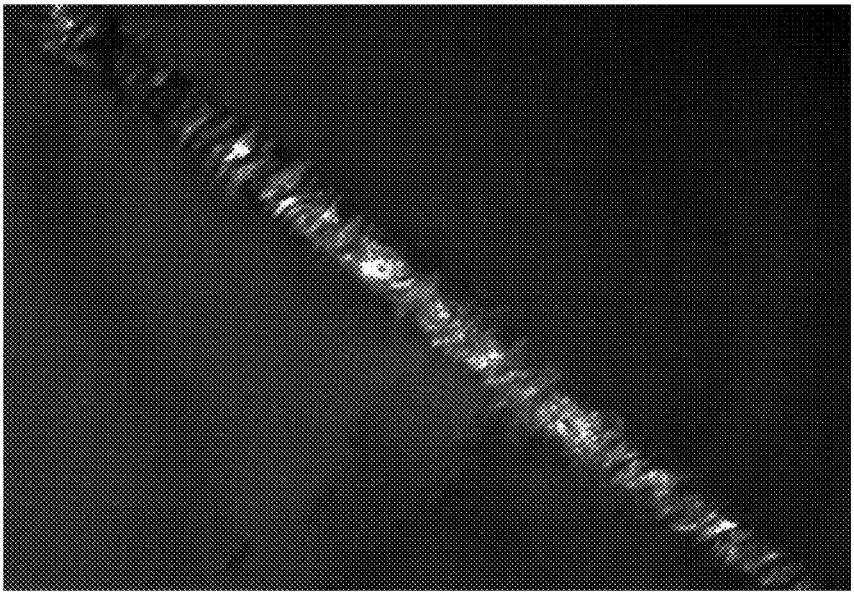
Figure 6:
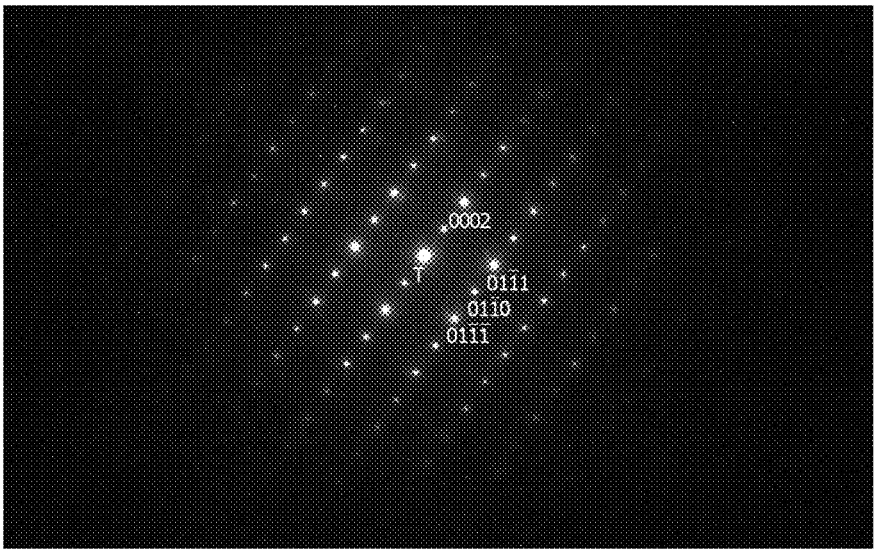
Figure 6:
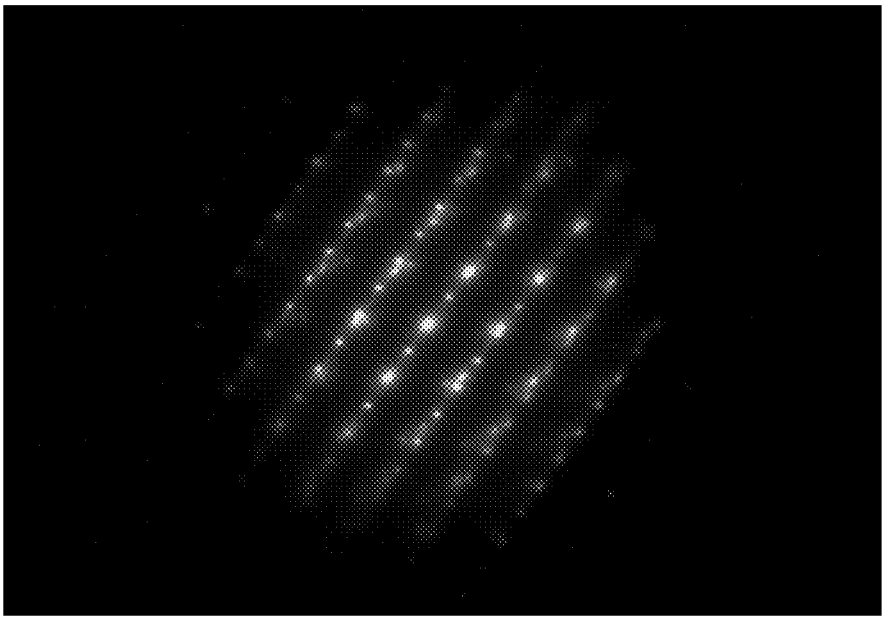
Figure 7:
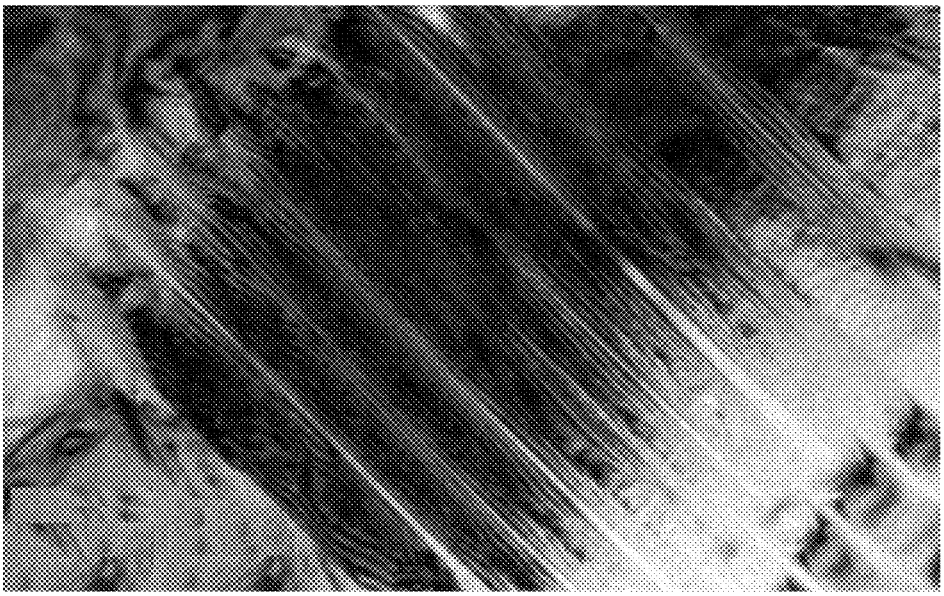
FIGS. 7(*a*), 7(*b*) and 7(*c*) are views of the transmission electron microscope (TEM) observation of the experiment 2 in the present invention after treating at 950° C. , which show that the high density dislocations of the needle organization base has disappeared, where FIG. 7(*a*) is a bright field view, FIG. 7(*b*) is a dark field view, and FIG. 7(*c*) is SADP by Axis [11$\bar{2}$0].
Figure 7:
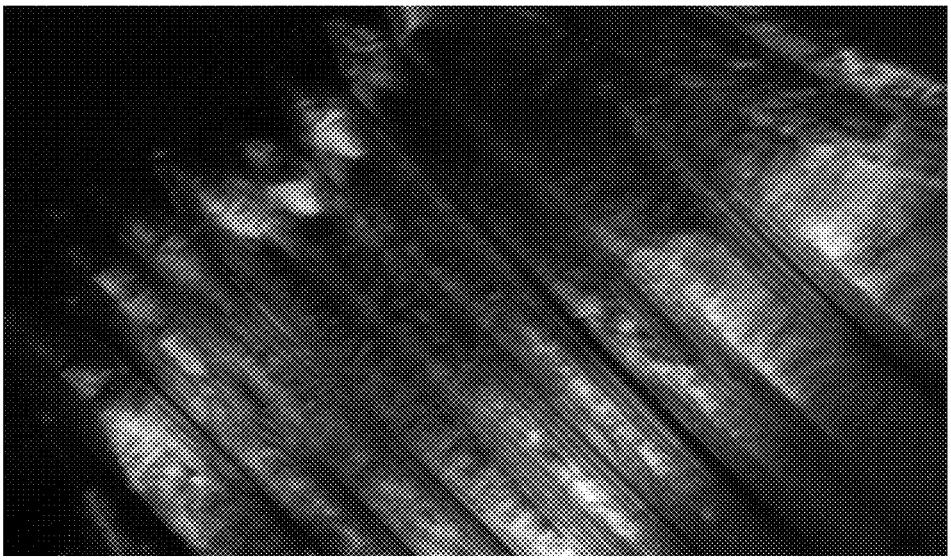
Figure 7:
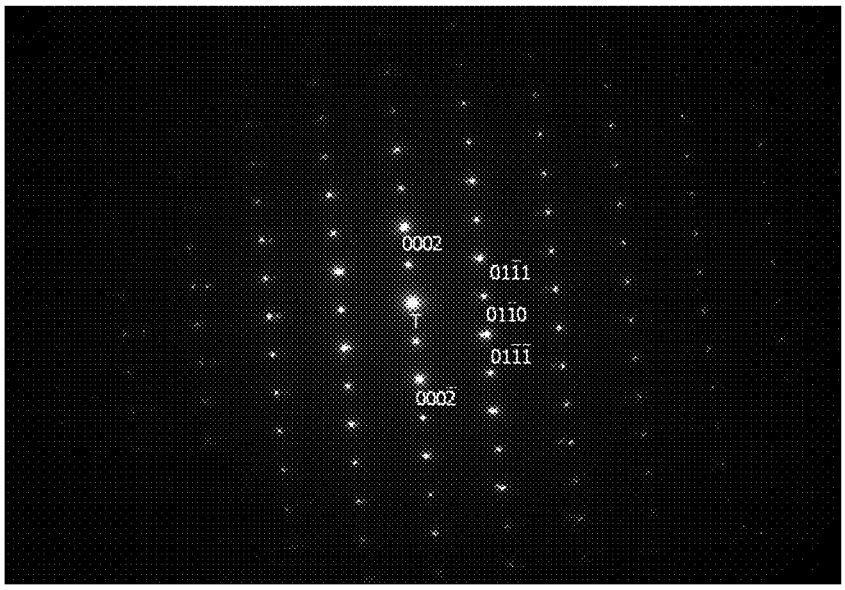
Figure 8:
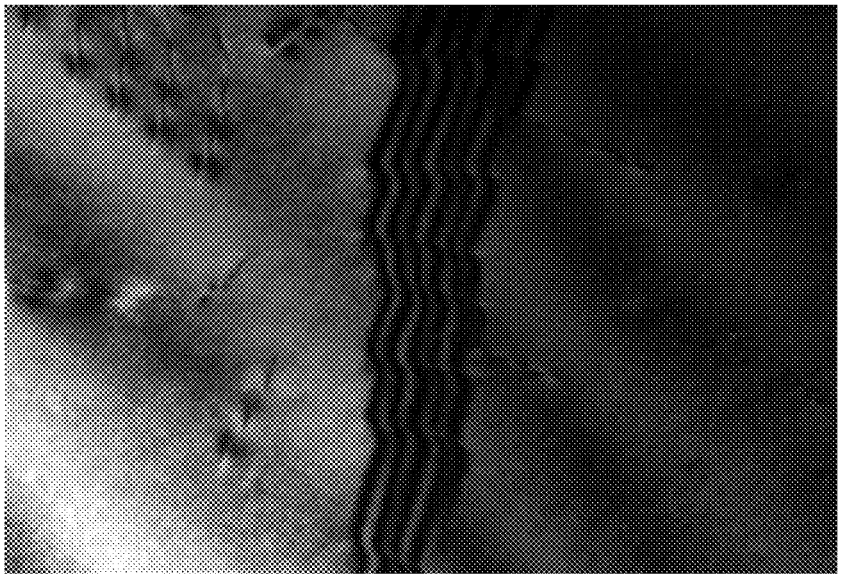
FIGS. 8(*a*), 8(*b*) and 8(*c*) are views of the transmission electron microscope (TEM) observation of the experiment 2 in the present invention after treating at 900° C., which show that the high density dislocations of the needle organization base has disappeared, where FIG. 8(*a*) is a bright field view, FIG. 8(*b*) is a dark field view, and FIG. 8(*c*) is SADP by Axis [11$\bar{2}$0].
Figure 8:
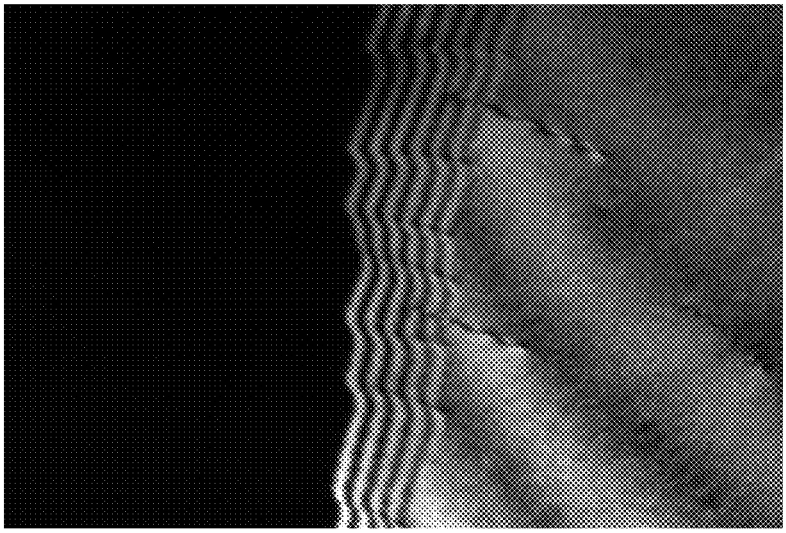
Figure 8:
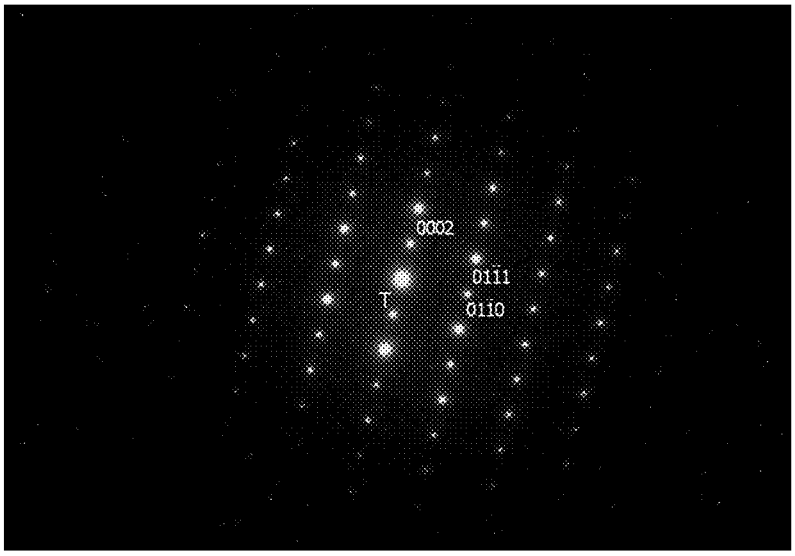
Figure 9:
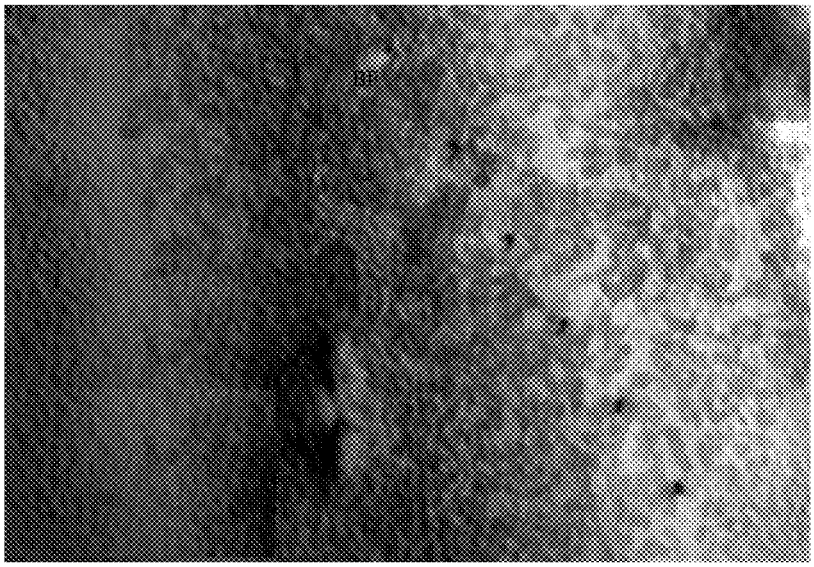
FIGS. 9(*a*), 9(*b*), 9(*c*) and 9(*d*) are views of the transmission electron microscope (TEM) observation of the experiment 2 in the present invention after treating at 800° C., which show the $\alpha_2$ phase formed within the interfacial interphase of the base, where FIG. 9(*a*) is a bright field view, FIG. 9(*b*) is a dark field view of the base, FIG. 9(*c*) is a dark field view of the $\alpha_2$ phase, and FIG. 9(*d*) is SADP by Axis [11$\bar{2}$0].
Figure 9:
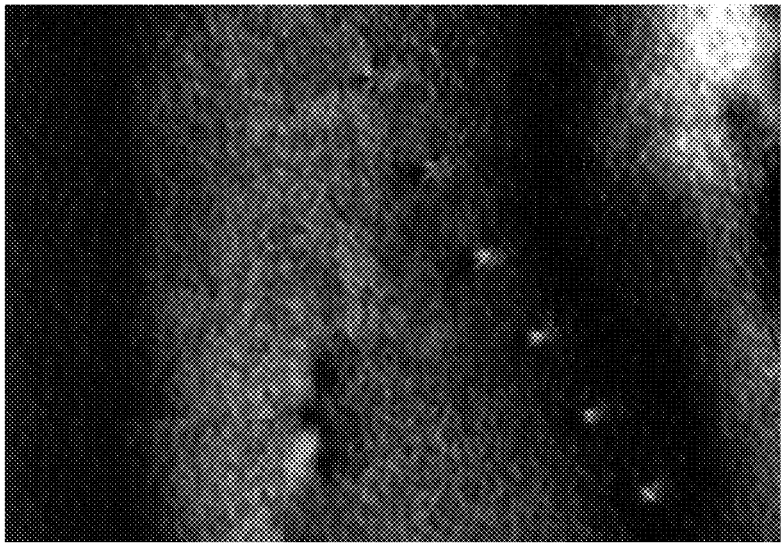
Figure 9:
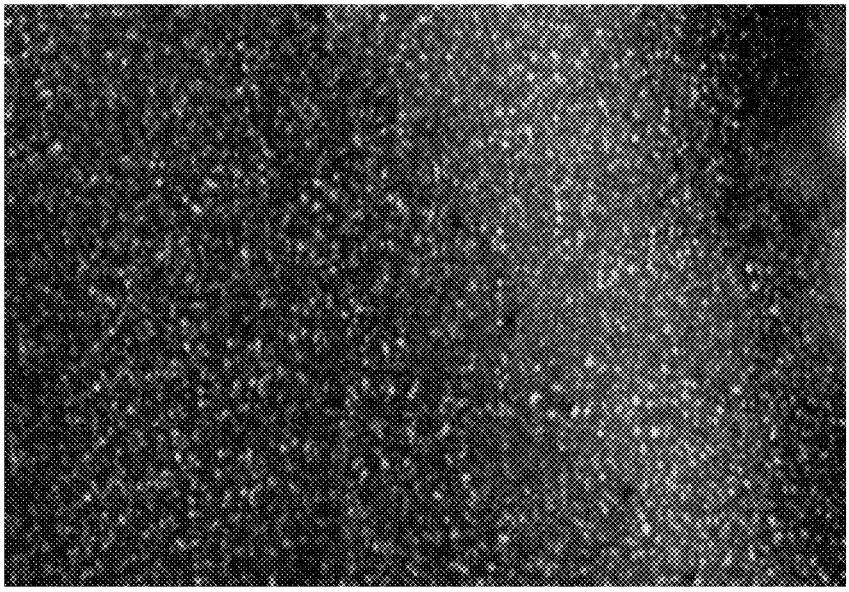
Figure 9:
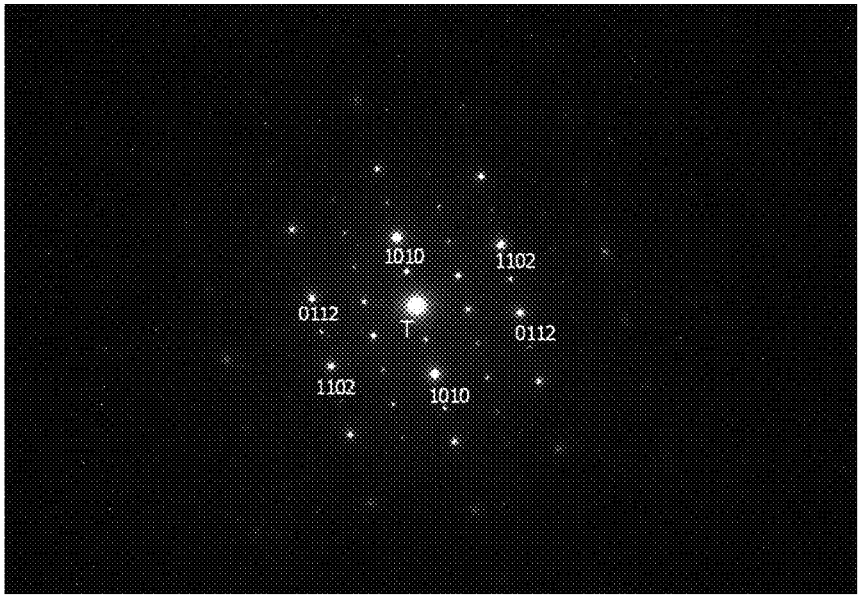
Figure 10:
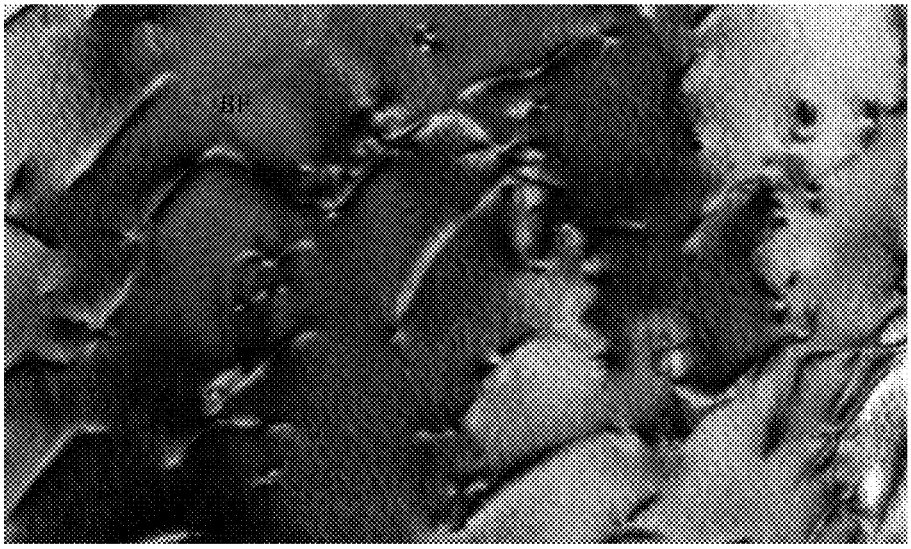
FIGS. 10(*a*), 10(*b*), 10(*c*) and 10(*d*) are views of the transmission electron microscope (TEM) observation of the experiment 2 in the present invention after treating at 700° C., which show the $\alpha_2$ phase formed within the interfacial interphase of the base, where FIG. 10(*a*) is a bright field view, FIG. 10(*b*) is a dark field view of the base, FIG. 10(*c*) is a dark field view of the $\alpha_2$ phase, and FIG. 10(*d*) is SADP by Axis [11$\bar{2}$0].
Figure 10:
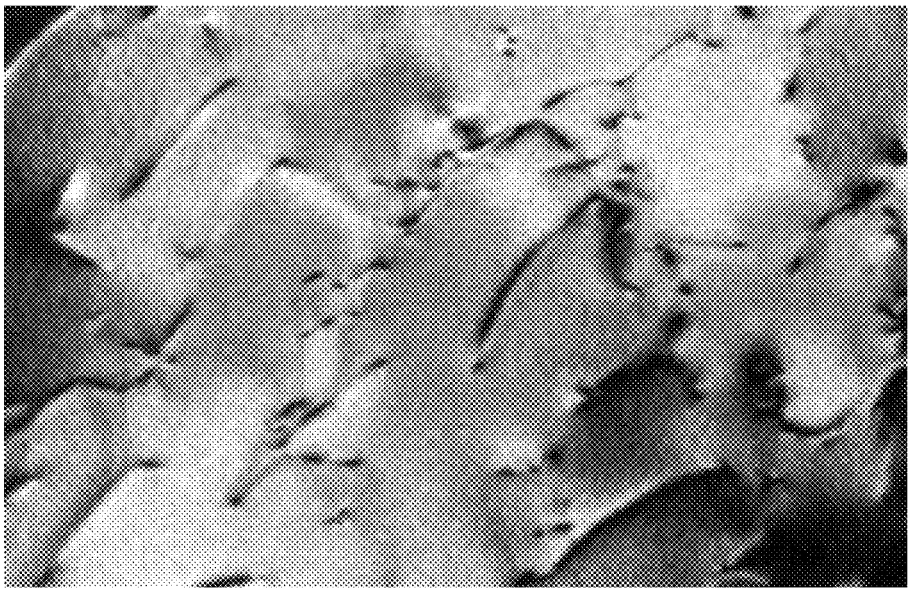
Figure 10:
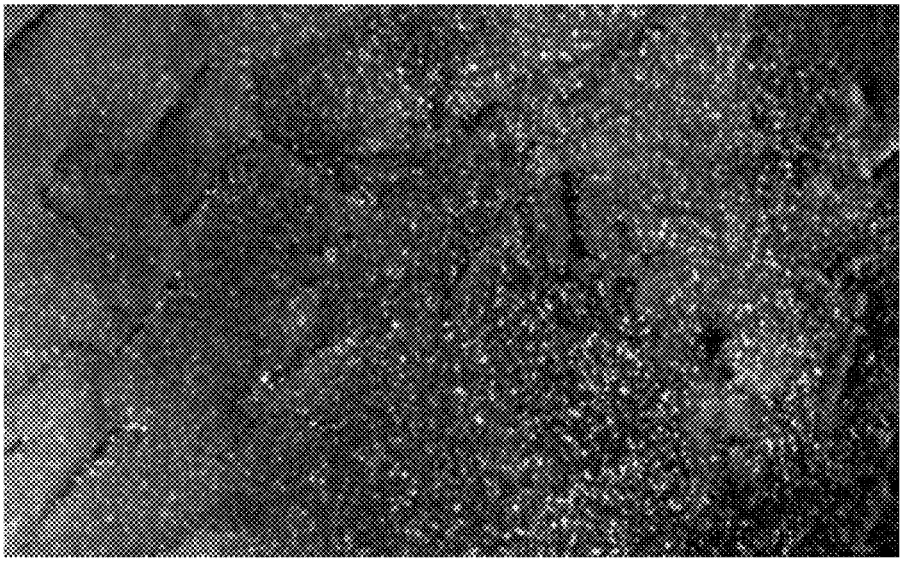
Figure 10:
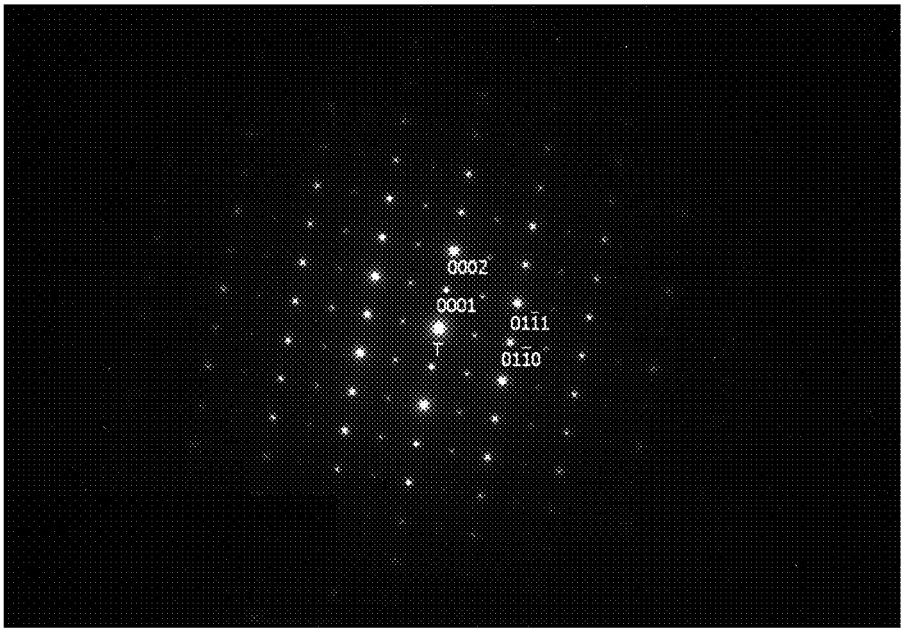

Furthermore, FIGS. 5(*a*)~10(*d*) are the results of transmission electron microscopy (TEM) observations. FIGS. 5(*a*)-(*d*) and FIGS. 6(*a*)-(*d*) show that the alloy has high density dislocations at the martensite base after heat treatment at 1000° C. The precipitations of the interfacial interphase between the bases also can be observed, and the formation of the interfacial interphase will cause the brittleness to be raised and the elongation reduced. FIGS. 7(*a*)-(*c*) and FIGS. 8(*a*)-(*c*) show that the alloy has lower density dislocations of the bases after heating at the temperature between 900 and 950° C. for 1 hour, while no interface is observed between the bases. That is to say, the alloy can obtain higher toughness or elongation by heating within the range of the abovementioned temperature. FIGS. 9(*a*)-(*d*) and FIGS. 10(*a*)-(*d*) show that the alloy has regular $DO_{19\alpha 2}$-phase within the bases after heating at the temperature between 700 and 800° C. for 1 hour. In general, the golf club head made of the Ti—Al alloy in the present invention is subject to heat treatment at a high temperature of 925±25° C. to avoid the precipitation or $\alpha_2$ phase of the interfacial interphase so as to improve the embrittlement phenomena. The elongation of the alloy is enhanced to 6~15%. At the same time, the alloy has a density of 4.18~4.30 g/cm$^3$ to improve the design flexibility of the golf club head.

It should be noted that if there is no specific description in the invention mentioned above, the "%" means "weight percent (wt %)", and the numerical range (e.g. 10%~11% of A) contains the top and lower limit (i.e. 10%≤A≤11%). If the lower limit is not defined in the range (e.g. less than, or below 0.2% of B), it means that the lower limit is 0 (i.e. 0%≤B≤0.2%). The combination of elements represented by (C+D+E) refers to the total content of the elements within the brackets, and the content of any element could be 0 (if the lower limit comprises 0, it is also possible that the content of each element is 0). Besides, term "balanced F" refers to "the rest ratio is complemented to 100wt % by F."

The present invention has been described with preferred embodiments thereof and it is understood that many changes and modifications to the described embodiments can be carried out without departing from the scope and the spirit of the invention that is intended to be limited only by the appended claims.

What is claimed is:

1. A golf club head having at least a portion of the golf club head made of a titanium-aluminum alloy, the titanium-aluminum alloy comprising:

10~11 wt % aluminum;

trace elements comprising (C+N+O)<0.2 wt %,Si<0.2 wt %, and (Fe+Cr+V+Mo) <0.4 wt %; and the balance being titanium;

wherein the titanium-aluminum alloy is subject to a heat treatment at 925 ±25° C. for 1-4hours to obtain a tensile strength in a range of 90~110 kips/in$^2$and a density in a range of 4.18~4.30 g/cm$^3$, and the titanium-aluminum alloy after the heat treatment has no α2-phase in an interfacial interphase thereof.

2. The golf club head according to claim 1, wherein the heat treatment is hot isostatic pressing, swaging, or forging.

3. The golf club head according to claim 1, wherein the time of heat treatment is 1 hour.

4. The golf club head according to claim 1, wherein the elongation of the titanium-aluminum alloy is 6~15%.

5. The golf club head according to claim 1, wherein the volume of the golf club head is ranged between 410 and 470 cm3, and the weight is ranged between 180 and 210 grams.

6. A low density alloy of a golf club head, comprising:

10~11 wt % aluminum, trace elements comprising (C+N+O)<0.2 wt %, Si<0.2 wt %, and (Fe+Cr+V+Mo) <0.4 wt %; and the balance being titanium, wherein the low density alloy has a tensile strength in a range of 90~110 kips/in$^2$, a density in a range of 4.18~4.30 g/cm$^3$ and an elongation in a range of 6~15%, and the low density alloy has no α2-phase in an interfacial interphase thereof.

* * * * *